US005394816A

United States Patent [19]

Kunstat

[11] Patent Number: 5,394,816

[45] Date of Patent: Mar. 7, 1995

[54] MARINE FASTENER SYSTEM WITH INTERCHANGEABLE IDENTIFICATION TAGS

[76] Inventor: Robert M. Kunstat, 470 W. End #4G, New York, N.Y. 10024

[21] Appl. No.: 179,161

[22] Filed: Jan. 10, 1994

[51] Int. Cl.[6] ..... B63B 21/04

[52] U.S. Cl. ..... 114/218

[58] Field of Search ..... 114/218, 343, 364; 283/100, 105, 74, 81; 24/115 R; 40/627, 631, 621

[56] References Cited

U.S. PATENT DOCUMENTS

| | | | |
|---|---|---|---|
| 2,930,155 | 3/1960 | Becker | 40/631 X |
| 3,431,568 | 3/1969 | Brown | 114/218 X |
| 3,828,714 | 8/1974 | Perkins | 114/218 |
| 5,224,439 | 7/1963 | O'Connell et al. | 40/621 X |
| 5,261,343 | 11/1993 | Elterman et al. | 114/218 |

OTHER PUBLICATIONS

Donald Street, The Ocean Sailing Yacht, 1973, pp. 257–259.

*Primary Examiner*—Sherman Basinger

[57] ABSTRACT

A marine fastener system in which interchangeable identification tags are secured to the fastener body by use of the very same screws which secure the fastener to the deck or mast. This avoids any need to make additional screw holes and yet permits a ready and permanent way of ascertaining the function of each fastener. It is possible to mark such tags using a luminous paint, so that the tags can easily be read in the dark.

10 Claims, 2 Drawing Sheets

MARINE FASTENER SYSTEM WITH INTERCHANGEABLE IDENTIFICATION TAGS

SPECIFICATION

1. Field of the Invention

This invention relates to the field of marine fasteners, such as cleats or linestoppers, which are used to secure the standing or running rigging of a boat, such as a sailboat. In particular, the invention relates to a convenient means of labeling such fasteners, to facilitate identification of their purpose.

2. Prior Art

A conventional method of affixing a line on a sailboat is by means of a cleat or linestopper. It is often difficult to tell, among a welter of lines, which one controls which sail or belongs on which fastener. Especially on a racing sailboat, on an unfamiliar boat, or at night, this can be a considerable problem.

A conventional means of reducing this confusion is to label the cleats with an adhesive plastic tape made with a labeling machine operated by hand pressure. This can work for a while, but the labels usually fall off after exposure to salt water and chafing by lines. It is also possible to use glued-on metal labels, but they also can fall off. Labels of metal or plastic screwed to the deck or mast are more secure, but this requires making screw holes for the labels, which is undesirable because it tends to cause the deck to leak or the mast to be weakened by these extra screw holes.

SUMMARY OF THE INVENTION

In the present invention, a marine fastener system is provided in which interchangeable identification tags can be secured to the fastener body by means of the very same screws which secure the fastener to the deck or mast. This avoids any need to make additional screwy holes and yet permits a ready and permanent means of ascertaining the function of each fastener.

Moreover, this is accomplished without having to mark the fastener body itself, as by engraving it or casting an identifying name into the fastener body. Such a means of identification, while permanent, would be commercially undesirable since it would necessitate stocking a wide range of fasteners, each marked with the name of a particular line; or making a large number of molds for casting each fastener with a different name, at great expense for tooling. Using the system of the invention, it is only necessary to make and stock a variety of flat metal tags, which can be done easily, compactly and relatively inexpensively.

In accordance with the invention, it is also possible to mark such tags using a luminous paint, so that the tags can easily be read in the dark.

DETAILED DESCRIPTION OF THE INVENTION

Figure 1:
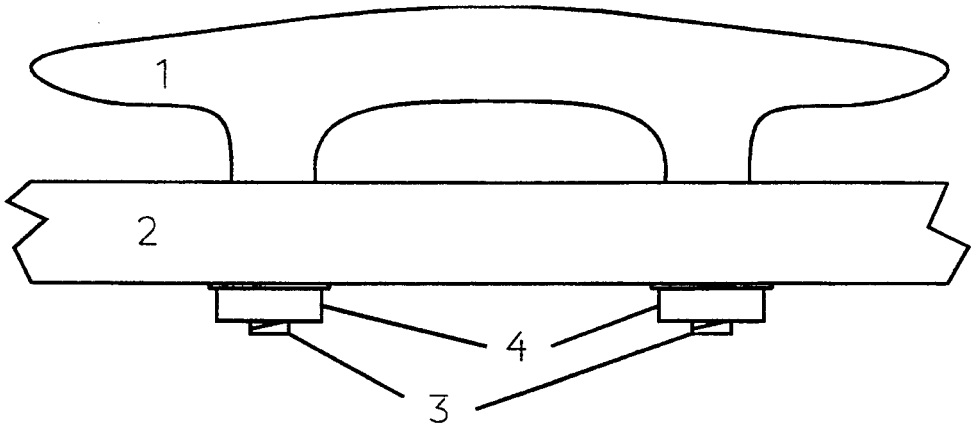
FIG. 1 is a side elevation of a marine fastener according to a first embodiment of the invention.
Figure 2:
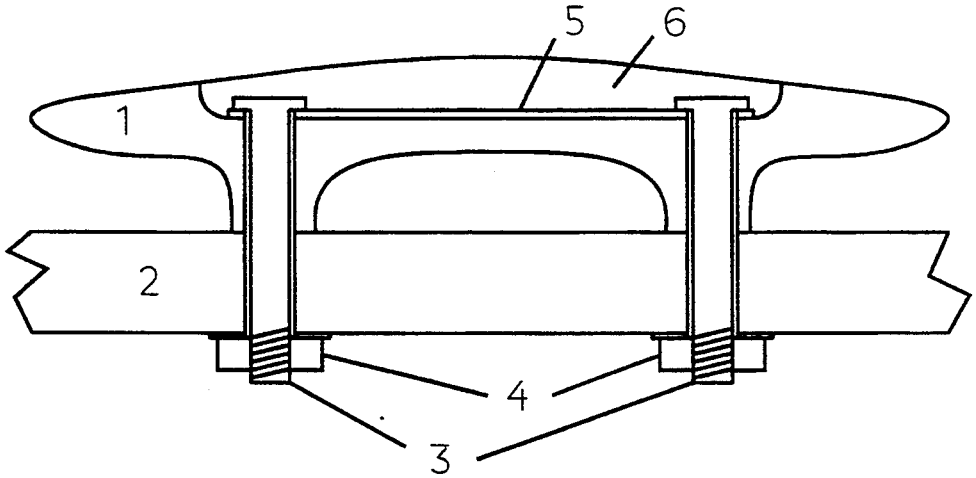
FIG. 2 is a longitudinal cross-section of the fastener of FIG. 1.
Figure 3:
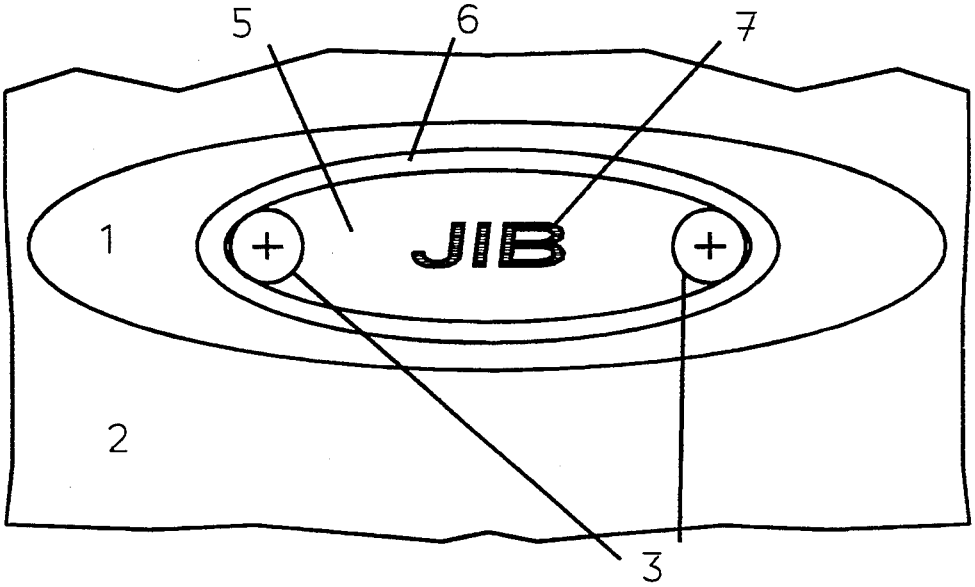
FIG. 3 is a top plan view of the fastener of FIG. 1.

Referring now to FIGS. 1–3, there is shown cleat 1 attached to deck 2 by means of screws 3 and nuts 4. Cleat 1 is provided with tag 5 which rests within recess 6 and is secured to cleat 1 by the same screws 3 and nuts 4 which secure cleat 1 to deck 2. Therefore, it is not necessary to make more than two holes in deck 2 in order to secure both cleat 1 and its tag 5.

Tag 5 may be made of metal or an engineering plastic, such as nylon. Tag 5 is provided with ID mark 7, which indicates the function of cleat 1, in this case to hold the jib halyard. It will be appreciated that any desired range of tags 5 may be prepared with desired ID marks 7, such a "main", "guy", "spinnaker", etc., or their abbreviations. Marks 7 may be made by any convenient means, such as stamping, printing, engraving, or casting on tags 5.

Optionally, ID marks 7 may be imprinted with any desired type of luminous ink, like that used on watches (for example, either a weakly radioactive ink or an ink which absorbs sunlight energy during the day and glows at night), to facilitate night identification.

Figure 4:
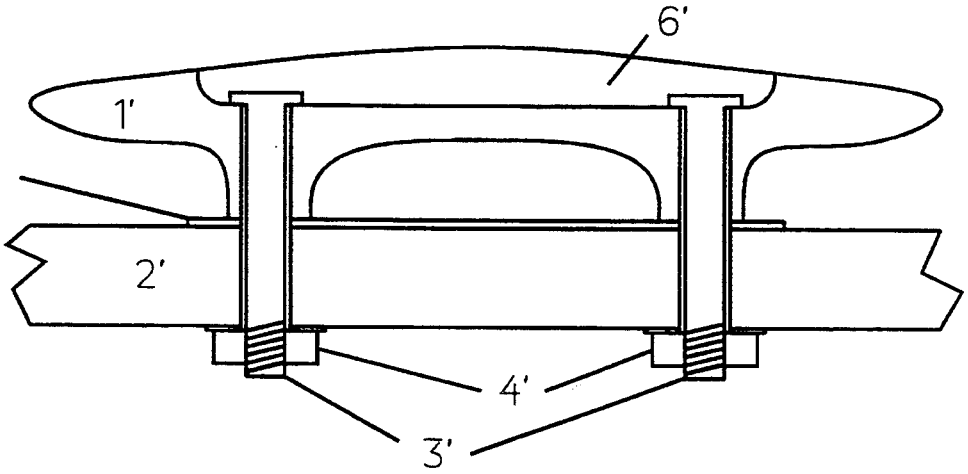
FIG. 4 is a longitudinal cross-section of a marine fastener according to another embodiment of the invention.
Figure 5:
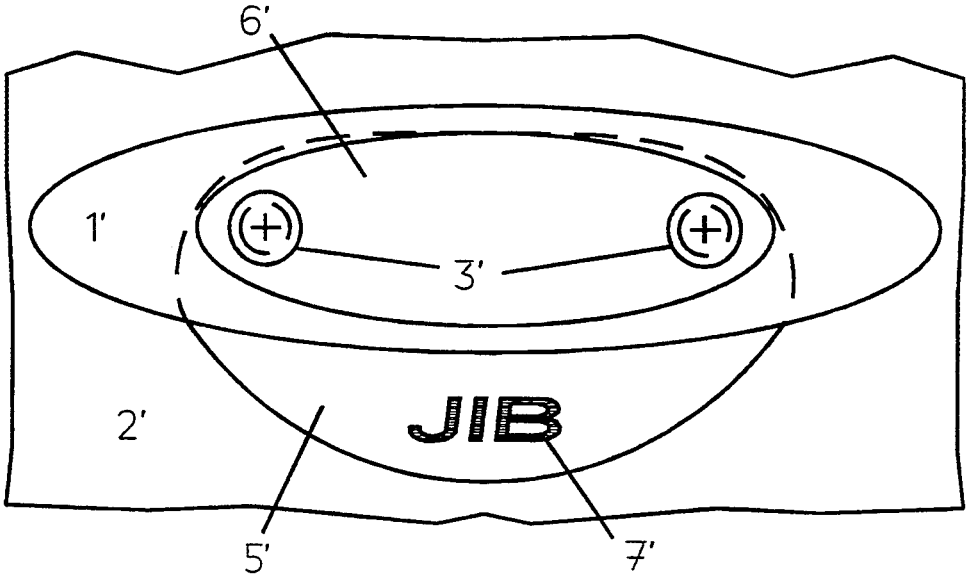
FIG. 5 is a top plan view of the fastener of FIG. 4.

Referring now to FIGS. 4–5, a second embodiment will be explained. In this case, tag 5' is not located within recess 6', rather it is sandwiched between cleat 1' and deck 2'. The same beneficial object is achieved, in that only two holes are needed to secure the entire assembly. In this case, tag 5' is somewhat larger, so as to project beyond the profile of cleat 1' and so permit ID marks 7' to be readable from the top, as seen in FIG. 5.

The invention is not limited to the exact embodiments shown, and may be realized in such other ways as will be apparent to the skilled artisan, utilizing the teachings of the invention.

I claim:

1. A marine fastener system comprising, in combination:

fastener body means for securing a line;

identification means for indicating which line is secured to said fastener body means; and attachment means extending through both said fastener body means and said identification means, for securing said fastener system to a support;

wherein both said fastener body means and said identification means are adapted to be secured to said support by said attachment means.

2. A marine fastener system according to claim 1, said fastener body means being adapted for removably securing to said support and said identification means being adapted for removably securing to said fastener body means.

3. A marine fastener system according to claim 2, said attachment means comprising a screw.

4. A marine fastener system according to claim 1, said identification means and said fastener body means each being provided with at least one hole, and said attachment means passing through both said holes.

5. A marine fastener system comprising, in combination:

line-holding means for securing a line;

identification means for indicating which line is secured to said line-holding means; and attachment means extending through both said fastener body means and said identification means, for securing said fastener system to a support;

wherein both said identification means and said line-holding means are adapted to be secured to said support by said attachment means.

6. A marine fastener system according to claim 5, said attachment means being provided with a head, and said identification means being adapted to be secured between said head and said line-holding means.

7. A marine fastener system according to claim 6, said line-holding means being provided with a recess adapted to receive said identification means.

8. A marine fastener system according to claim 7, said line-holding means comprising a cleat, said attachment means comprising a screw, and said identification means comprising a tag.

9. A marine fastener system according to claim 8, said tag being provided with luminous markings.

10. A marine fastener system according to claim 5, said attachment means being provided with a head, and said line-holding means being adapted to be secured between said head and said identification means.

* * * * *

UNITED STATES PATENT AND TRADEMARK OFFICE

CERTIFICATE OF CORRECTION

PATENT NO. : 5,394,816
DATED : March 7, 1995
INVENTOR(S) : Robert M. Kunstadt

It is certified that error appears in the above-identified patent and that said Letters Patent is hereby corrected as shown below:

On the title page, item [76] inventor, "kunstat" should read --Kunstadt--.

Signed and Sealed this

Eighteenth Day of April, 1995

Bruce Lehman

*Attest:*

BRUCE LEHMAN

*Commissioner of Patents and Trademarks*

*Attesting Officer*